US005183327A

United States Patent [19]

Fabbri

[11] Patent Number: 5,183,327

[45] Date of Patent: Feb. 2, 1993

[54] FLUORESCENT LIGHT FIXTURE WITH OPEN BALLAST HOUSING

[75] Inventor: William Fabbri, Billerica, Mass.

[73] Assignee: Keene Corporation, Union, N.J.

[21] Appl. No.: 757,217

[22] Filed: Sep. 10, 1991

[51] Int. Cl.[5] ..... F21S 3/00

[52] U.S. Cl. ..... 362/219; 362/221; 362/225; 362/260

[58] Field of Search ..... 362/219, 221, 225, 238, 362/249, 260

[56] References Cited

U.S. PATENT DOCUMENTS 2,434,781 1/1948 Kurtzon ..... 362/219

3,349,237 10/1967 Jackson ..... 362/219

*Primary Examiner*—Stephen F. Husar

*Attorney, Agent, or Firm*—Kane, Dalsimer, Sullivan, Kurucz, Levy, Eisele and Richard

[57] ABSTRACT

A fluorescent lighting fixture is provided with an assembly housing on the top thereof formed of sidewalls and a removable cover and endcaps. When the cover and endcaps are removed, sequential end-on-end placement of a plurality of the fluorescent lighting fixtures causes a channel to be formed into which a continuous common electrical power line is placed. Each ballast assembly communicates with the electrical power line.

9 Claims, 2 Drawing Sheets

FLUORESCENT LIGHT FIXTURE WITH OPEN BALLAST HOUSING

BACKGROUND OF THE INVENTION

1. Field of the Invention

This invention relates to a fluorescent light fixture with an assembly housing with removable portions to allow for simplified wiring of sequential fluorescent light fixtures.

2. Description of the Prior Art

In the prior art, fluorescent light fixtures have ballast assemblies which include terminals to which electrical power lines are individually attached. This is adequate for individual or small-scale applications which require a limited number of fluorescent fixtures. However, for large-scale industrial or commercial applications wherein several fluorescent light fixtures are sequentially arranged in rows, the wiring of the ballast assemblies from a common electrical power line is tedious and time-consuming.

OBJECTS AND SUMMARY OF THE INVENTION

It is therefore an object of this invention to provide a fluorescent light fixture wherein the ballast assembly receives an electrical power line in a simplified way.

It is therefore a further object of this invention to provide a fluorescent light fixture wherein a plurality of these fixtures may be sequentially arranged with each ballast assembly receiving power from a single electrical power line.

It is therefore a still further object of this invention to provide a fluorescent light fixture wherein the assembly housings form a continuous channel when several fluorescent light fixtures are sequentially placed end-on-end.

It is therefore a final object of this invention to provide a fluorescent light fixture with an assembly housing wherein the cover is easily removable.

These and other objects are attained by providing a fluorescent light fixture with an assembly housing on an upper side thereof with a removable cover and endcaps. The assembly housing extends substantially the entire longitudinal length of the fluorescent light fixture. Therefore, when several of these fluorescent light fixtures are sequentially placed end-on-end in long rows, a channel is formed by the assembly housings. A single power line is placed in the channel formed by the assembly housings. The ballast assemblies are then sequentially wired to the common power line by use of Scotch-Locks® or similar connectors or similar devices which do not sever the common power line, but rather slice through a portion of the outer insulation to contact the inner conductor of the common power line.

BRIEF DESCRIPTION OF THE DRAWINGS

Further objects and advantages of the invention will become apparent from the following description and claims, and from the accompanying drawings, wherein:

DETAILED DESCRIPTION OF THE PREFERRED EMBODIMENT

Figure 1:
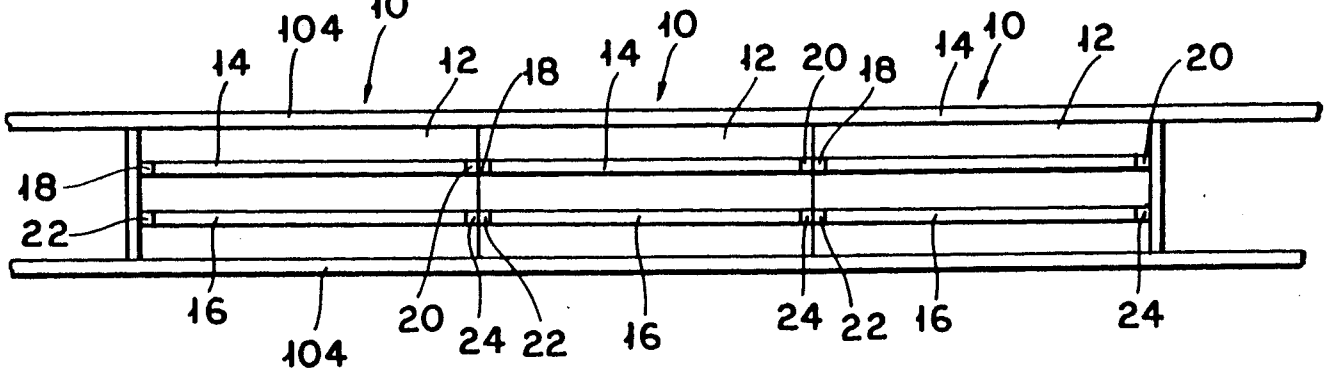
FIG. 1 is a bottom plan view of fluorescent light fixtures of the present invention sequentially arranged end-on-end.

Referring now to the drawings in detail wherein like numerals indicate like elements throughout the several views, FIG. 1 is a bottom plan view of fluorescent light fixtures 10 of the present invention sequentially arranged end-on-end. Each fluorescent light fixture 10 includes a body 12 and two (any number may be used) longitudinal fluorescent bulbs 14, 16. Fluorescent bulb 14 is engaged by sockets 18, 20 while fluorescent bulb 16 is engaged by sockets 22, 24. This arrangement is particularly suited for mounting fluorescent light fixtures 10 upon a grid 104, which may comprise inverted T-rails (not shown).

Figure 2:
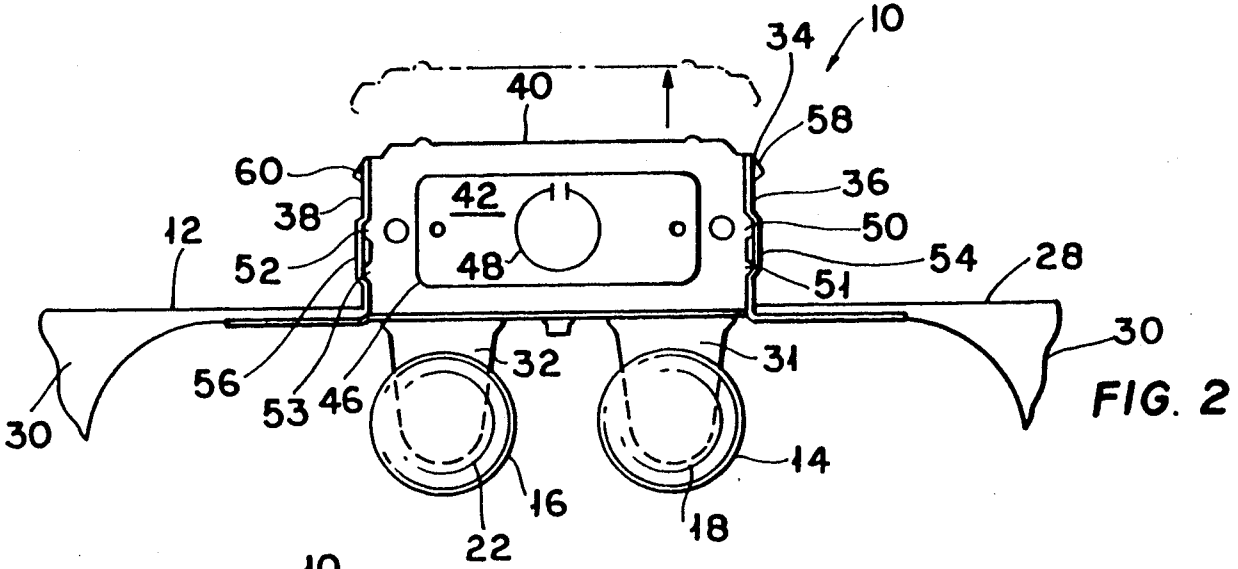
FIG. 2 is an end plan view, partly in cross-section, of the fluorescent light fixture of the present invention.

FIG. 2 shows an end plan view of fluorescent light fixture 10. Fluorescent light fixture 10 includes horizontal panel 28 which forms the upper portion of body 12. Lateral sides of panel 28 include walls 30 (see FIG. 3) which engage grid 104 (see FIG. 1). Lamp holders 31, 32 extend downwardly from central portions of longitudinal ends of horizontal panel 28 to sockets 18, 22 (and 20, 24) to engage bulbs 14, 16 (see FIG. 1). On the upper side of horizontal panel 28, immediately above lamp holders 31, 32, is assembly housing 34. Assembly housing 34 comprises sidewalls 36, 38, cover 40 and endcap 42.

Figure 3:
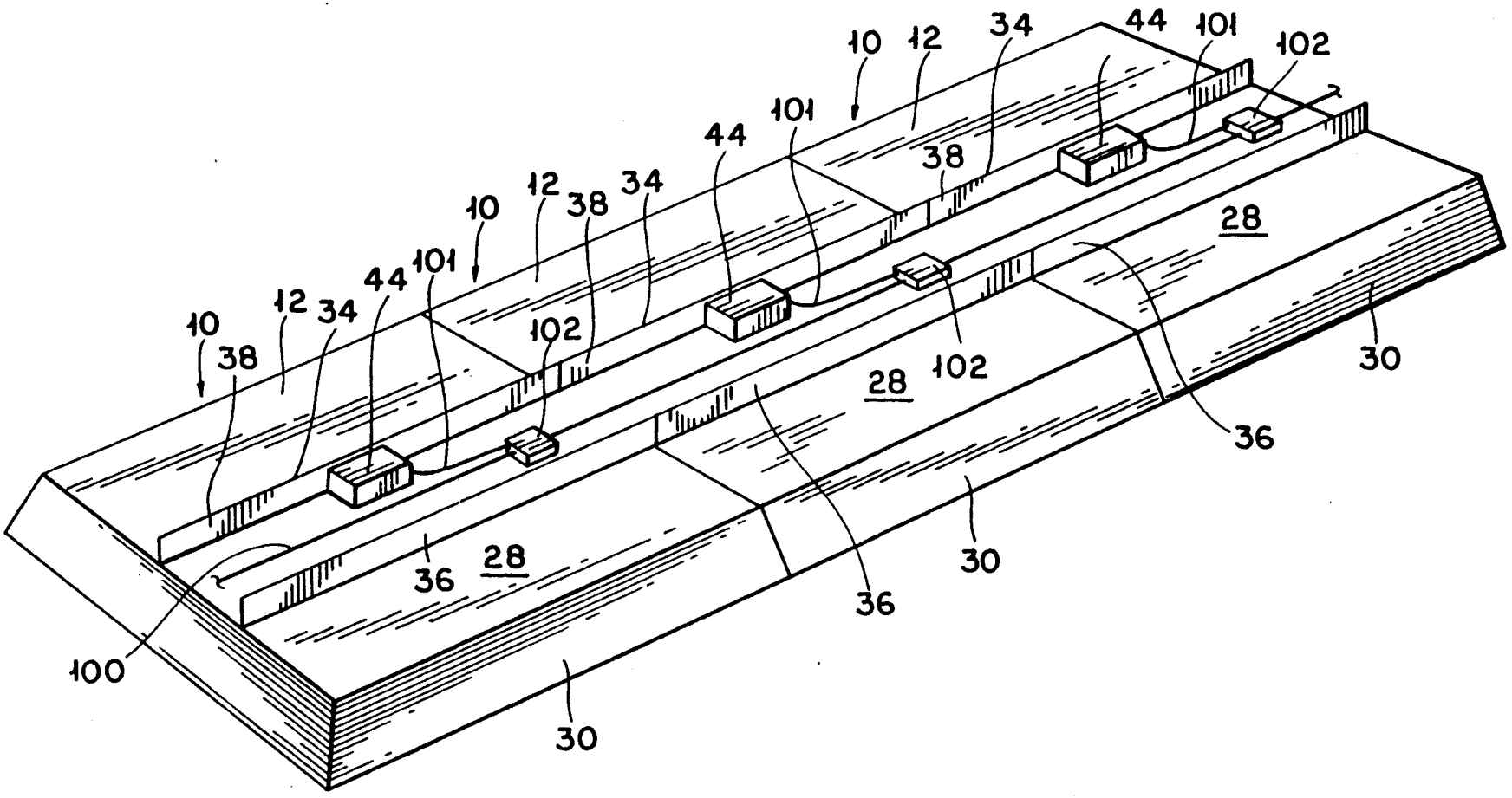
FIG. 3 is a top perspective view of fluorescent light fixtures of the present invention sequentially arranged end-on-end.

As shown in FIG. 3, ballast assembly 44 is placed on an upper side of panel 28 in between sidewalls 36, 38 within assembly housing 34. As is known in the prior art, ballast assembly 44 receives electrical power from an external source and provides electricity in both a start-up and steady-state mode to fluorescent bulbs 14, 16 via sockets 18, 20, 22, 24.

Sidewalls 36, 38 are permanently affixed to horizontal panel 28. Endcap 42 includes removable portions 46, 48 defining potential apertures through which electrical power lines may be passed for other applications. Endcap 42 is removably attached to sidewalls 36, 38 by outwardly extending prongs 50, 51, 52, 53 which detently engage lateral troughs 54, 56 of sidewalls 36, 38. Cover 40 includes lateral inwardly extending detent flanges 58, 60 to engage the upper edge of sidewalls 36, 38. Cover 40 and endcap 42 are both removable from sidewalls 36, 38 to form the sequential configuration shown in FIG. 3. As shown in FIG. 3, upon removal of cover 40 and endcaps 42 (both sides), and the placing of several fluorescent light fixtures 10 end-on-end, sidewalls 36, 38 form a channel which includes the ballast assemblies 44 which are in electrical communication with common power line 100 via leads 101 to connectors 102 (the ground connection is not shown). Connectors 102 are preferably Scotch-Locks® or similar devices which do not sever common power line 100, but rather slice through a portion of the outer insulation to contact the inner conductor of common power line 100.

In order to install fluorescent light fixtures 10, a user removes endcaps 42 and cover 40 and engages a series of fluorescent light fixtures 10 upon grid 104. The user places common power line 100 in the channel formed by sequential sidewalls 36, 38 and attaches leads 101 from ballast assemblies 44 to common power line 100 by connectors 102. The user then replaces cover 40 onto sidewalls 36, 38. Obviously, there are many variations in the installation procedure.

Thus the several aforementioned objects and advantages are most effectively attained. Although a single preferred embodiment of the invention has been disclosed and described in detail herein, it should be understood that this invention is in no sense limited thereby and its scope is to be determined by that of the appended claims.

What is claimed is:

1. In a fluorescent light fixture of the type comprising a body, a ballast assembly engaging said body and bulb-engaging sockets in electrical communication with said ballast assembly, the improvement comprising an assembly housing including sidewalls extending substantially along a longitudinal length of said body whereby when a plurality of fluorescent light fixtures are sequentially placed end-on-end a common channel extending along a length of the plurality of fluorescent light fixtures is formed by said sidewalls for receiving a common electrical power line longitudinally therein, and a removable cover engaging upper portions of said sidewalls thereby providing access to said common channel.

2. The improvement of claim 1 wherein said ballast assembly engages said body between said sidewalls.

3. The improvement of claim 2 wherein said ballast assembly includes electrical leads within said channel for communication with the common electrical power line extending within said channel when a plurality of the fluorescent light fixtures are sequentially placed end-on-end.

4. The improvement of claim 1 further including removable endcaps engaging vertical ends of said sidewalls.

5. The improvement of claim 4 wherein said endcaps include outwardly extending prongs which detently engage lateral troughs of said sidewalls.

6. The improvement of claim 3 wherein said cover includes lateral inwardly extending detent flanges engaging upper edges of said sidewalls.

7. The improvement of claim 3 wherein said electrical leads of said ballast assembly are adapted to engage the common electrical power line by use of connectors which do not require the complete severance of the common electrical power line.

8. The improvement of claim 4 wherein said endcaps include removable portions to expose apertures.

9. The improvement of claim 3 wherein said cover is replaced on said sidewalls after said leads are connected to the common electrical power line.

* * * * *